US006860066B2

(12) United States Patent
Kunz et al.

(10) Patent No.: US 6,860,066 B2
(45) Date of Patent: Mar. 1, 2005

(54) SHOELESS CURL SPRING COUNTERBALANCE SYSTEM FOR A TILT-IN WINDOW

(75) Inventors: John R. Kunz, Douglassville, PA (US); Keith Kannengieszer, Hatfield, PA (US)

(73) Assignee: John Evans Sons, Inc, Lansdale, PA (US)

( * ) Notice: Subject to any disclaimer, the term of this patent is extended or adjusted under 35 U.S.C. 154(b) by 0 days.

(21) Appl. No.: 10/417,598

(22) Filed: Apr. 18, 2003

(65) Prior Publication Data

US 2004/0206001 A1 Oct. 21, 2004

(51) Int. Cl.[7] ..... E05D 15/22
(52) U.S. Cl. ..... 49/181; 49/445
(58) Field of Search ..... 49/181, 176, 445, 49/446, 447; 16/197, 199, 200, DIG. 16

(56) References Cited

U.S. PATENT DOCUMENTS

| | | | | | |
|---|---|---|---|---|---|
| 3,399,490 | A | * | 9/1968 | Hettinger | 49/414 |
| 3,842,540 | A | * | 10/1974 | Anderson | 49/181 |
| 4,227,345 | A | * | 10/1980 | Durham, Jr. | 49/181 |
| 4,364,199 | A | * | 12/1982 | Johnson et al. | 49/181 |
| 4,452,012 | A | * | 6/1984 | Deal | 49/181 |
| 4,837,976 | A | * | 6/1989 | Westfall et al. | 49/430 |
| 4,930,254 | A | * | 6/1990 | Valentin | 49/181 |
| 5,157,808 | A | * | 10/1992 | Sterner, Jr. | 16/197 |
| 5,210,976 | A | * | 5/1993 | Cripps | 49/181 |
| 5,353,548 | A | | 10/1994 | Westfall | 49/446 |
| 5,452,495 | A | * | 9/1995 | Briggs | 16/193 |
| 5,463,793 | A | | 11/1995 | Westfall | 16/197 |
| 5,855,092 | A | * | 1/1999 | Raap et al. | 49/181 |
| 6,032,417 | A | * | 3/2000 | Jakus et al. | 49/181 |
| 6,058,653 | A | * | 5/2000 | Slocomb et al. | 49/181 |
| 6,119,398 | A | * | 9/2000 | Yates, Jr. | 49/181 |
| 6,378,169 | B1 | | 4/2002 | Batten et al. | 16/197 |
| 6,658,794 | B1 | * | 12/2003 | Hansel et al. | 49/181 |

* cited by examiner

*Primary Examiner*—Gregory J. Strimbu
(74) *Attorney, Agent, or Firm*—LaMorte & Associates

(57) ABSTRACT

A counterbalance system for a tilt-in window and its associated method of operation. The system uses wound spring elements to provide a counterbalancing force to the sashes of the window. The wound springs are configured to define open central regions. Hubs are attached to tilt posts that extend from the sashes of the window. The hubs extend into the open central regions of the wound springs, thereby supporting the wound springs within the frame of the window. A brake structure is disposed between the wound springs and the tilt posts. The brake structure creates multiple braking actions. First, the brake structure itself creates an interference fit within the frame of the window as the sashes tilt. Second, the brake structure displaces the wound spring and causes the wound spring to press against the frame of the window as the sashes tilt.

8 Claims, 5 Drawing Sheets

SHOELESS CURL SPRING COUNTERBALANCE SYSTEM FOR A TILT-IN WINDOW

BACKGROUND OF THE INVENTION

1. Field of the Invention

In general, the present invention relates to counterbalance systems for windows that prevent open window sashes from closing under the force of their own weight. More particularly, the present invention system relates to counterbalance systems for tilt-in windows that use curl springs to create a counterbalancing force.

2. Description of the Prior Art

There are many types and styles of windows. One of the most common types of windows is the double-hung window. A double-hung window is the most common window found in traditional home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. However, the sashes can also be selectively tilted into the home so that the exterior of the sashes can be cleaned from within the home.

The sash of double-hung windows has a weight that depends upon the materials used to make that window sash and the size of the window sash. Since the sashes of a double-hung window are free to move up and down in the frame of a window, some counterbalancing system must be used to prevent the window sashes from always moving to the bottom of the window frame under the force of their own weight.

For many years counterbalance weights were hung next to the window frame in weight wells. The weights were attached to the window sash using a string or chain that passed over a pulley at the top of the window frame. The weights counterbalanced the weight of the window sashes. As such, when the sashes were moved in the window frame they had a neutral weight and friction would hold them in place.

The use of weight wells prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and wooden frame windows. The present invention is mainly concerned with the structure of vinyl framed windows. As such, the prior art concerning vinyl framed windows is herein addressed.

Vinyl framed, tilt-in, double-hung windows are typically manufactured with tracks along the inside of the window frame. Brake shoe mechanisms, commonly known as "shoes" in the window industry, are placed in the tracks and ride up and down within the tracks. Each sash of the window has two tilt pins or tilt posts that extend into the shoes and cause the shoes to ride up and down in the tracks as the window sashes are opened or closed.

The shoes serve two purposes. First, the shoes contain a brake mechanism that is activated when a window sash is tilted inwardly away from the window frame. The shoe therefore locks the base of the sash in place and prevents the base of the sash from moving up or down in the window frame once the sash is titled open. Second, the shoes support curl springs. Curl springs are constant force coil springs that supply a constant retraction force when unwound. Traditionally, curl springs are placed within the shoe in the same way a metal tape is placed within the housing of a tape measure. One end of the curl spring is anchored to the frame of the window while the main body of the curl spring is wound inside of the shoe. As the shoes move within the tracks, the curl spring rotates inside the shoe. Often as the curl spring rotates in the shoe, the curl spring moves around within the confines of the shoe and makes an undesirable noise.

Single curl springs are used on windows with light sashes. Multiple curl springs are used on windows with heavy sashes. The curl springs provide the counterbalance force to the window sashes needed to maintain the sashes in place. The counterbalance force of the curl springs is transferred to the window sashes through the structure of the shoes.

Prior art shoes that contain braking mechanisms and support counterbalance curl springs are exemplified by U.S. Pat. No. 6,378,169 to Batten, entitled Mounting Arrangement For Constant Force Spring Balance; U.S. Pat. No. 5,463,793 to Westfall, entitled Sash Shoe System For Curl Spring Window Balance; and U.S. Pat. No. 5,353,548 to Westfall, entitled Curl Spring Shoe Based Window Balance System.

Prior art "shoes" for curl spring counterbalance systems are complex assemblies. The shoes must contain a brake mechanism strong enough to lock a sash in place. Furthermore, the shoes must engage and retain the end of at least one strong curl spring. Prior art shoes are always in contact with the tracks on the sides of the window frame. Accordingly, as wear, dirt and grime accumulate over time, it often becomes more difficult for the shoes to move up and down. The "shoe" of a window assembly is therefore the first part of a window assembly to fail and require replacement. A shoe can fail either by failing to smoothly move within the window frame track or by failing to lock in place when a window sash is tilted open.

Another disadvantage of prior art shoes is that the shoes take space in the tracks on the side of the window sashes. Accordingly, the window sash cannot be fully opened to the top of the window track because of the physical presence of the shoes. Building codes exist that define the minimal size of a window opening in many applications. The minimal size opening is required so that people can pass through the open window in case of an emergency. Accordingly, due to the presence of prior art shoes, windows that have sashes that are larger than building code requirements may not be able to open to a size that meets the building code requirement.

A need therefore exists in the field of vinyl, tilt-in, double-hung windows, for a counterbalance system that eliminates the need for shoes. As such, window assemblies can be made more reliable, less noisy, less expensive and with larger effective openings. This need is met by the present invention as described and claimed below.

SUMMARY OF THE INVENTION

The present invention is a counterbalance system for a tilt-in window and its associated method of operation. The system uses wound spring elements to provide a counterbalancing force to the sashes of the window. The wound springs are configured to define open central regions. Hubs are attached to tilt posts that extend from the sashes of the window. The hubs extend into the open central regions of the wound springs, thereby supporting the wound springs within the frame of the window. A brake structure is disposed between the wound springs and the tilt posts. The brake structure automatically locks the tilt posts into fixed positions as the sashes of the tilt-in window are tilted inwardly. The brake structure creates two braking actions. First, the brake structure itself creates an interference fit within the frame of the window as the sashes tilt. Second, the brake structure displaces the wound spring and causes the wound spring to press against the frame of the window as the sashes tilt. The two separate braking actions create a strong and effective brake for the tilt posts of the sashes without the use of traditional window brake shoe assemblies.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
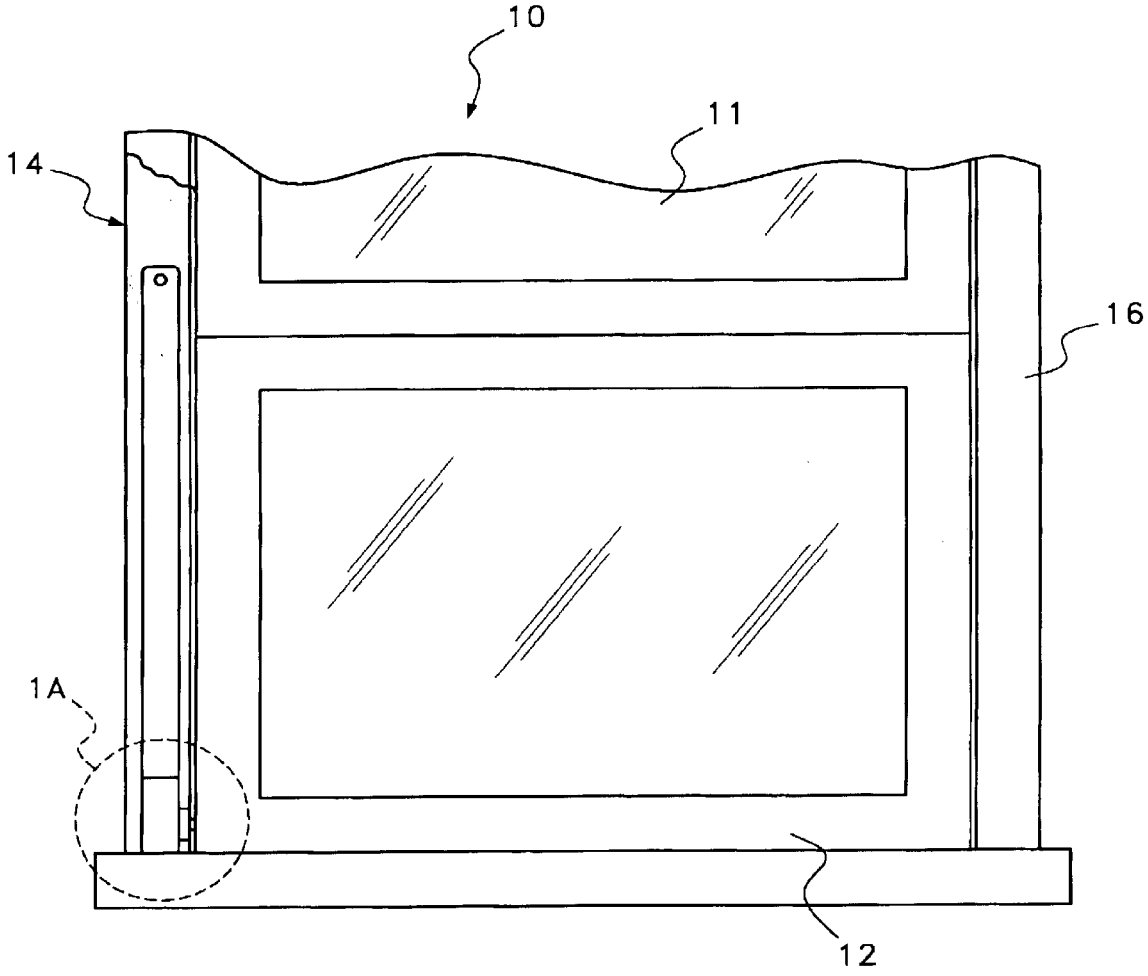
FIG. 1 is a partially fragmented view of a window assembly in accordance with the present invention.

Referring to FIG. 1, there is shown an exemplary embodiment of a vinyl, tilt-in, double-hung window assembly 10. The window assembly 10 has an upper sash 11 and a lower sash 12. The upper sash 11 and the lower sash 12 are contained within a window frame 14. The window frame 14 has two vertical sides 16 that extend along the sides of both sashes 11, 12. Within each of the vertical sides 16 of the window frame 14 is formed a track 18.

A tilt post 20 extends outwardly from either side of the base of each sash 11, 12. The tilt posts 20 extend into the tracks 18 in the vertical sides 16 of the window frame 14. As is later explained in greater detail, a brake head 22 is disposed at the tip of the tilt post 20 within the track 18. The brake head 22 serves two purposes. First, the brake head 22 serves as a brake mechanism that locks the tilt post 20 in place within the track 18 when a sash 11, 12 is tilted inwardly. Second, the brake head 22 serves as a hub for a curl spring 24, wherein a curl spring 24 passes around the brake head 22.

The curl spring 24 rotates about the brake head 22. The free end of the curl spring 24 is affixed to the window frame 14 higher along the track 18. Accordingly, the curl spring 24 applies an upward counterbalance force to the tilt post 20 that counteracts the weight of the sash 12.

Figure 1A:
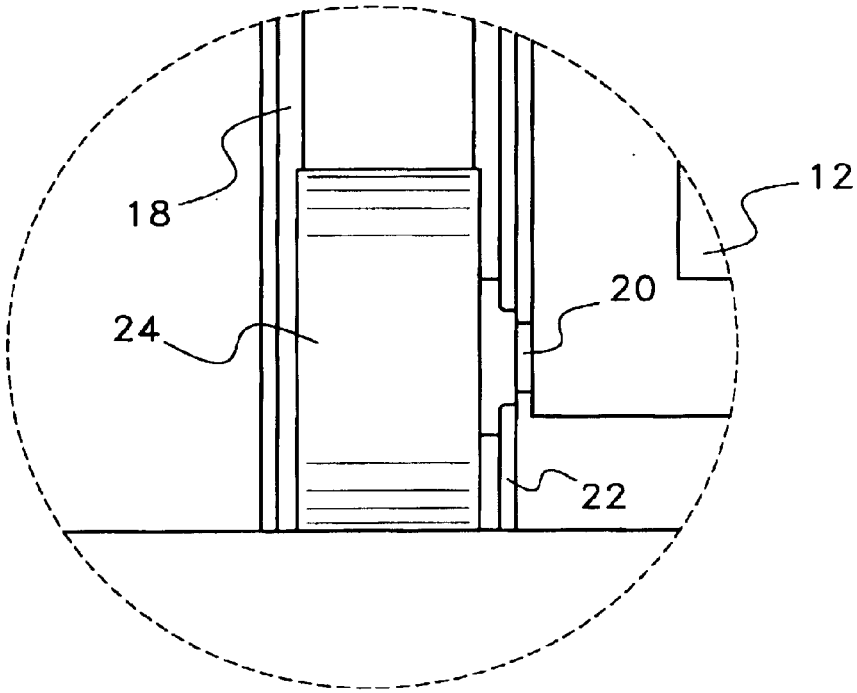
FIG. 1A is an enlarged view of the section of FIG. 1 contained within circle 1A.

Referring to FIG. 1A in conjunction with FIG. 1, it can be seen that a tilt post 20 extends outwardly from either side of the base of each sash 11, 12. The tilt posts 20 extend into the tracks 18 in the vertical sides 16 of the window frame 14. As is later explained in greater detail, a brake head 22 is disposed at the tip of the tilt post 20 within the track 18. The brake head 22 serves two purposes. First, the brake head 22 serves as a brake mechanism that locks the tilt post 20 in place within the track 18 when a sash 11, 12 is tilted inwardly. Second, the brake head 22 serves as a hub for a curl spring 24, wherein a curl spring 24 passes around the brake head 22.

Figure 2:
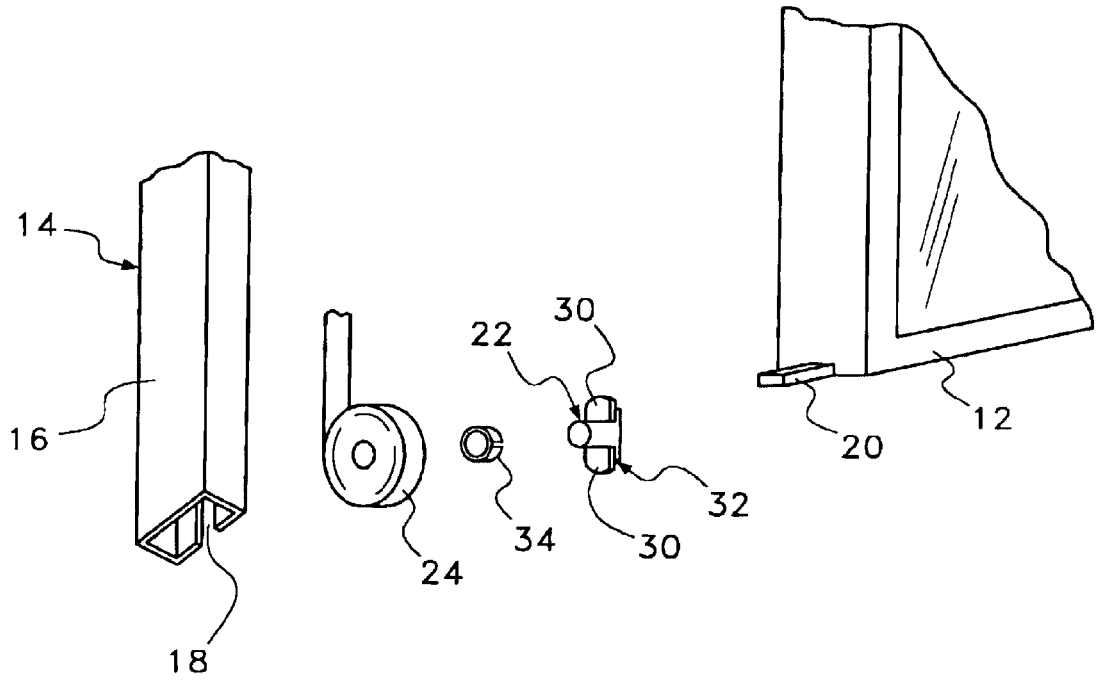
FIG. 2 is a perspective, exploded view of the counterbalance system shown in FIG. 1.

Referring to FIG. 2, it can be seen that the tilt post 20 is a metal post that is mounted directly to the window sash 12. The tilt post has a non-circular cross-section. In the shown embodiment, the tilt post 20 has a rectangular cross-sectional shape. However, this is only exemplary and it should be understood that other non-circular shapes can be used.

The brake head 22 is a structure that passes over the end of the tilt post 20. A recess (shown in FIG. 3) is provided in the tip of the brake head 22. The recess is shaped to receive the tip of the tilt post 20. The tip of the tilt post 20 passes into the recess in the brake head 22. As a result, once the brake head 22 passes into the tilt post 20, a keyed connection occurs and the brake head 22 cannot be rotated without the rotation of the entire tilt post 20.

The brake head 22 is a structure that includes flanges 30 and a cylindrical hub 32 that extends behind the flanges 30. The purpose and function of the flanges 30 is later explained. The cylindrical hub 32 is sized to pass into an annular spring bearing 34. As such, the annular spring bearing 34 is free to rotate around the cylindrical hub 32 of the brake head 22. The spring bearing 34 passes into the center of a standard window curl spring 24. The spring bearing 34 may be slotted so that the spring bearing 34 can be momentarily compressed when inserted into the center of the curl spring 24. Once inserted into the center of the curl spring 24, the spring bearing 34 expands so that no space exists between the exterior of the spring bearing 34 and the interior of the curl spring 24.

In the embodiment of FIG. 2, it can be seen that the tilt post 20 and the brake head 22 are manufactured as separate elements that are assembled together. It will be understood that such a manufacturing method is merely exemplary and that the tilt post 20 and brake head 22 can be manufactured as a single piece. For example, the brake head 22 and tilt post 20 can be cast or machined as a single metal piece. Alternatively, a plastic brake head can be molded around a metal tilt post, thereby creating one inseparable assembly. The two piece assembly illustrated in FIG. 2 is used because it is considered the lowest cost method of producing the brake head/tilt post assembly.

Figure 3:
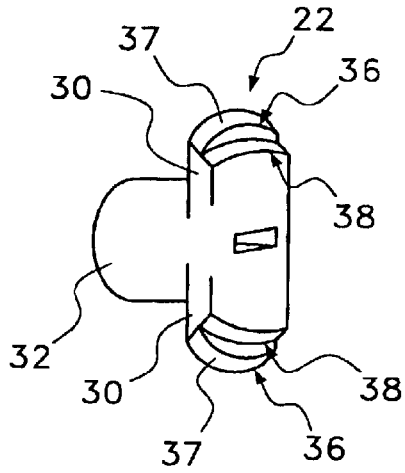
FIG. 3 is a perspective view of an exemplary embodiment of the brake head component of the counterbalance system.

Referring to FIG. 3, it can be seen that the brake head 22 has a complex shape. The cylindrical hub 32 of the brake head 22 comprises the majority of the brake head 22. However, flanges 30 radially extend from the cylindrical hub 32 at one end of the cylindrical hub 32. The flanges 30 extend above and below the cylindrical hub 32. No flanges 30 extend from the sides of the cylindrical hub 32. As a result, the flanges 30 combine to provide the brake head 22 with an elongated configuration at one end of the cylindrical hub 32.

The flanges 30 above and below the cylindrical hub 32 have a stepped structure. Each of the flanges 30 have a distal edge 36 at their tip and a second edge 38 interposed between the distal edge 36 and the center of the hub 32. The flanges 30 have a first thickness near the distal edge 36. Further down from each distal edge 36 is a step that forms the second edge 38. Accordingly, below the second edge 38, the flanges 30 are thicker and lay flush with the front end of the cylindrical hub 32. However, above the second edges 38, the flanges 30 are recessed. The flanges 30 are further thinned near the distal edges 36 by the presence of a bevel 37 that leads to the distal edge 36.

Figure 4B:
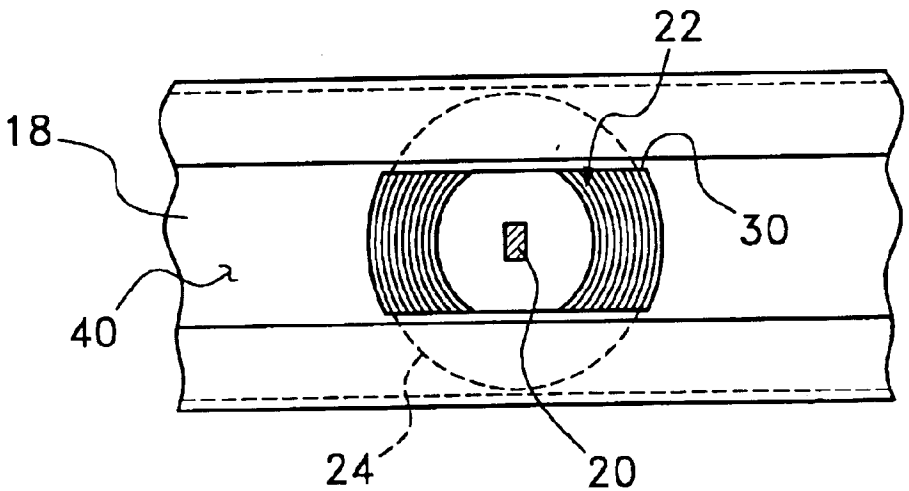
FIG. 4B is a front view of the counterbalance system shown in FIG. 4A.
Figure 4A:
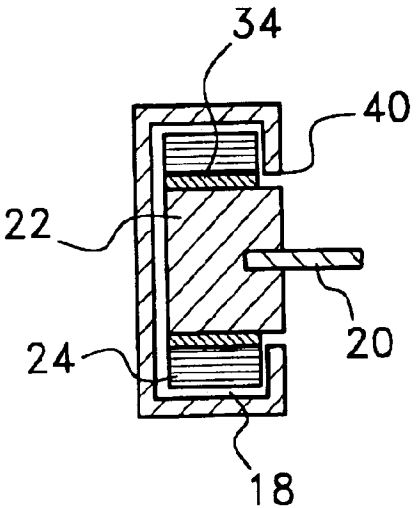
FIG. 4A is a side view of the counterbalance system in a window frame track.

Referring now to FIGS. 4A and 4B, it can be seen that the track 18 in each side of the window frame is accessible through a long slot 40 that runs along the length of the window frame. When the window sash 12 (FIG. 1) is not tilted, the tilt post 20 orients the brake head 22 in the track 18 so that the flanges 30 on the brake head 22 do not engage the window track 18 or the slot 40 at any point. The brake head 22 is therefore free to move up and down along the length of the track 18 without touching the track 18. The brake head 22 supports the spring bearing 34 (FIG. 2) in the center of the curl spring 24. Accordingly, as the brake head 22 moves up and down in the track 18, the curl spring 24 is moved up and down in the track 18, wherein the curl spring 24 either winds or unwinds depending upon the direction of movement. However, the curl spring 24 is not confined within a shoe, and the only movement of the curl spring 24 is its rotation around the brake head 22. As such, each curl springs 24 is prevented from making contact noise as it winds and unwinds.

It will be understood that when the sash 12 (FIG. 2) of the window is closed, the brake head 22 and the curl spring 24 are both free to move in the track 18. This allows the window sash 12 (FIG. 2) to move up and down unencumbered in the window frame.

Figure 5B:
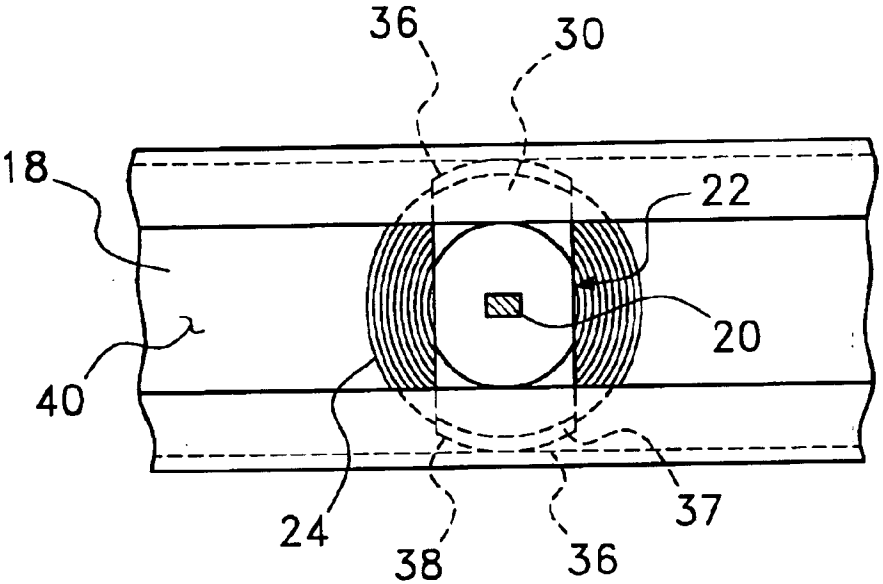
FIG. 5B is a front view of the counterbalance system shown in FIG. 5A.
Figure 5A:
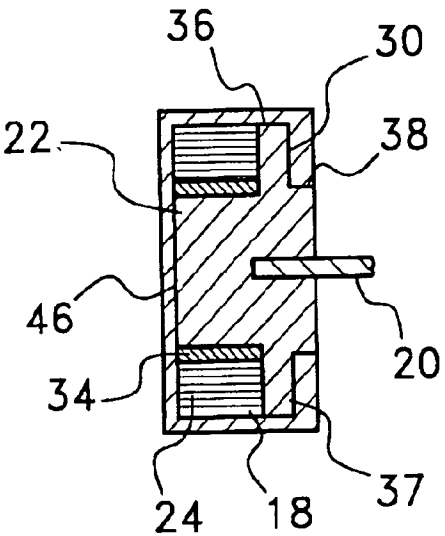
FIG. 5A is a side view of the counterbalance system in a window frame track.

Referring to FIGS. 5A and 5B, it can be seen that when the sash of the window is tilted forward, the tilt post 20 rotates. This causes the brake head 22 to rotate in the track 18. As the brake head 22 rotates in the track 18, two simultaneous braking actions occur that lock the brake head 22 in place within the track 18. The first braking action is caused by the flanges 30 that extend from the brake head 22. As the brake head 22 rotates, the flanges 30 rotate towards 90 degrees within the confines of the track 18. The second edges 38 of the flanges 30 rotate within the slot opening 40. The distal edges 36 of the flanges 30 rotate into the track 18 just behind the slot opening 40. The bevel 37 leading to the distal edges 36 of the flanges 30 prevent the distal edges 36 from catching on the open edges of the slot 40 as the flanges 30 rotate past these edges. As the flanges 30 rotate toward 90 degrees, contact occurs between the flanges 30 and the track 18 at two different points. As the distal edges 36 of the flanges 30 rotate, they contact the interior of the track 18, causing an interference fit. Simultaneously, the second edges 38 rotate and contact the open edges of the slot 40. This also causes an interference fit. Consequently, as the brake head 22 rotates, an interference occurs between the structure of the track 18 and both the distal edges 36 and the second edges 38 of the flanges 30. This wedges the brake head 22 in place and prevents the brake head 22 from being moved in the track 18.

As the brake head 22 is being rotated in the track 18 to cause an interference fit, yet another braking action is occurring. As the brake head 22 rotates in the track 18, the distal edges 36 of the flanges 30 enter the inside of the track 18. Due to the thickness of the flanges 30, the cylindrical hub 32 is driven farther into the track 18 as the distal edges 36 of the flange 30 rotate into the inside of the track 18.

The cylindrical hub 32 supports the curl spring 24 within the track 18. As the cylindrical hub 32 is driven farther into the interior of the track 18 by the entrance of the flanges 30 into the track 18, the curl spring 24 is driven further into the interior of the track 18. The brake head 22 is sized so that as the flanges 30 turn into the track 18, the curl spring 24 becomes compressed between the rear wall 46 of the track 18 and the flanges 30 on the brake head 22. The combined width of the curl spring 24 and the flanges 30 of the brake head 22 in the track 18 is wider than the track 18. Thus, an interference fit is created when the brake head 22 is rotated and the flanges 30 enter the track 18. The interference fit biases the curl spring 24 against the rear wall 46 of the track 18. This prevents the curl spring 24 from moving in the track 18. The abutment against the rear wall 46 of the track 18 also hinders the curl spring 24 from winding or unwinding.

Accordingly, when the brake head 22 is rotated from the free moving orientation of FIG. 4A into the locked position of FIG. 5A, multiple locking actions occur. The flanges 30 of the brake head 22 contact the interior of the track and the edges of the slot in the track 18, thereby locking the brake head 22 in place. Furthermore, the brake head 22 biases the curl spring 24 against the rear wall 46 of the track 18, thereby locking the curl spring 24 in place. The combined locking actions create a very strong overall locking mechanism that prevents the tilt post 20 from moving within the window track 18 once the window sash 12 (FIG. 1) is titled.

From the description of the function of the brake head 22, it will be understood that the brake head 22 itself is a solid object with no moving parts. The brake head 22 is attached to the tilt post 20 and rotates with the tilt post 20. When in a first orientation, the brake head 22 moves freely in the track 18 of the window. When rotated, the brake head 22 creates multiple interferences with both the structure of the track 18 and the curl spring 24 in the track. However, since the brake head 22 itself is a solid, one-piece structure with no moving parts, it is highly reliable and resists wear much better than prior art brake shoes that contain complex moving brake assemblies.

It will be understood that the embodiments of the present invention counterbalance system that are described and illustrated herein are merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. In a tilt-in window assembly having a sash and tracks that extend along opposite sides of the sash, wherein the sash is selectively positionable between a non-tilted position and a tilted position, a counterbalance system for the sash, comprising:

tilt posts extending from the opposites sides of the sash, wherein each of the tilt post extends into a retrospective one of the tracks;

a respective brake structure coupled to each of said tilt posts and disposed within a respective one of the tracks, each said brake structure being free moving in the respective track when in a first orientation and creating an interference fit with the respective track when rotated to a second orientation, wherein said tilt posts retain said brake structures in said first orientation when the sash is in said non-tilted position, and wherein said tilt posts rotate said brake structures into said second orientation when the sash is moved from said non-titled position to said tilted position; and a plurality of wound springs, each of said wound springs having a free end anchored in a respective one of the tracks, wherein each of said wound springs define a central opening, and wherein each of said brake structures extends into the central opening of a respective one of said wound springs, thereby supporting said wound spring within the respective one of the tracks;

wherein said brake structures bias said wound springs against the tracks when said brake structures are in said second orientation.

2. The assembly according to claim 1, wherein said springs are free to move within said tracks with said brake structures in said first orientation.

3. The assembly according to claim 1, wherein each of said brake structures contains a hub that passes into said central opening of said respective one of said wound springs, wherein said wound springs are free to rotate around said hubs as said brake structures move in said tracks.

4. The assembly according to claim 3, further including a respective bearing element disposed in said central opening of each of said wound springs, wherein said bearing element passes over said hub on each of said brake structures, thereby enabling said wound springs to better rotate.

5. The assembly according to claim 1, wherein each of said brake structures contains at least one flange that contacts an interior surface of said respective one of the tracks when said brake structures are in said second orientation, said interference fit.

6. In a tilt-in window assembly having a sash, tracks that extend along the opposite sides of the sash, and tilt posts that extend from opposite sides of the sash into the tracks, wherein the sash is selectively positionable between a non-tilted position and a tilted position, a brake system for locking the tilt posts into place within the tracks when the sash is the tilted position, said brake system comprising:

solid, single-piece brake heads each coupled to a respective one of the tilt posts and disposed within a respective one of the tracks, said brake heads having a structure that does not contact the tracks when the sash is in its non-titled position but creates an interference fit with the tracks when the sash is in its titled position; and counter balance springs supported by said brake heads within the tracks and having free ends anchored to said tracks, wherein said brake heads bias said counter balance springs against the tracks when the sash is in the tilted position.

7. The assembly according to claim 6, wherein each of said brake heads contains a central hub and flanges that radially extend from said central hub, wherein multiple contact surfaces are formed on said flanges.

8. The assembly according to claim 7, wherein each of said contact surfaces contacts a respective surface of said respective track when the sash is in the titled position.

* * * * *